United States Patent [19]

Worrall et al.

[11] Patent Number: 4,990,752

[45] Date of Patent: Feb. 5, 1991

[54] CONTROLLABLE ELECTRIC HEATER

[75] Inventors: Peter W. Worrall, Ferryhill Co.; Peter W. Crossley, Nevilles Cross, both of United Kingdom

[73] Assignee: Electrolux Limited, Durham, United Kingdom

[21] Appl. No.: 315,018

[22] Filed: Feb. 24, 1989

[30] Foreign Application Priority Data

Feb. 26, 1988 [GB] United Kingdom ..... 8804602
Sep. 9, 1988 [GB] United Kingdom ..... 8821152.9

[51] Int. Cl.[5] ..... H05B 1/02

[52] U.S. Cl. ..... 219/501; 219/483; 219/486; 219/485; 219/508; 307/38

[58] Field of Search ..... 219/501, 494, 497, 499, 219/483–486, 505, 506, 508, 509; 307/117, 38–41

[56] References Cited

U.S. PATENT DOCUMENTS

| | | | |
|---|---|---|---|
| 2,705,276 | 3/1955 | Wise | 219/488 |
| 3,247,358 | 4/1966 | Schmidt | 219/501 |
| 3,681,569 | 8/1972 | Schwarz | 219/501 |
| 4,085,309 | 4/1978 | Godel et al. | 219/364 |
| 4,731,519 | 3/1988 | Dieterle et al. | 219/501 |

*Primary Examiner*—M. H. Paschall
*Attorney, Agent, or Firm*—Christensen, O'Connor, Johnson & Kindness

[57] ABSTRACT

The present invention relates to controllable electric heaters, in particular heaters employing tungsten halogen lamps and suitable for use in cookers of the type having a ceramic hob below which are placed the heaters.

It is an object of the present invention to provide a controllable electric heater employing two tungsten halogen lamps and other components of an inexpensive nature and which allows six different power settings to be obtained.

5 Claims, 7 Drawing Sheets

CONTROLLABLE ELECTRIC HEATER

The present invention relates to controllable electric heaters, in particular heaters employing tungsten halogen lamps and suitable for use in cookers of the type having a ceramic hob below which are placed the heaters.

Heaters comprising tungsten halogen lamps are very suitable for use with ceramic hob cookers. However, for such use it is necessary that the heat output should be controllable, either continuously, or at a substantial number of different heating levels. To enable this to be done it has generally been necessary either to use three or four halogen lamps in combination with suitable switching circuits, or to use phase controllers or to resort to the use of energy regulators. The use of four lamps is expensive, phase control is restricted to below 200 watts, and energy regulators discard the beneficial visual properties of tungsten halogen heaters.

It is an object of the present invention to overcome or alleviate the above disadvantages.

Accordingly to the invention provides an AC electric heater circuit comprising at least one half-wave rectifier, at least one resistor and at least one electric heating element and multiple pole switching means connected to said resistor, half-wave rectifier and heating element in such a manner that in use, the heat output of the heater circuit can be varied by switching between at least the following states:

(i) at least one electric heating element in series with at least said resistor, (ii) at least one electric heating element in series with at least said half-wave rectifier and energized by half-wave rectified D.C.

(iii) at least one electric heating element energized at full power by substantially the full A.C. voltage across the input terminals of the heater circuit.

Preferably the circuit comprises two such electric heating elements, wherein said electric heating elements are tungsten halogen lamps and said multiple-pole switching means is so connected that in use, the heat output of the heater circuit can be varied by switching between at least the following additional states:

(iv) two tungsten-halogen lamps in series with at least said resistor, (v) two tungsten-halogen lamps in series and energized at the free terminals of their series combination by substantially the full AC voltage across the input terminals of the heater circuit, (vi) two tungsten-halogen lamps in parallel and either the individual tungsten-halogen lamps being connected in series with respective half-wave rectifiers or the parallel combination of tungsten halogen lamps being connected in series with a common half-wave rectifier whereby in either case they are energized by half-wave rectified D.C., (vii) whereby a total of at least six different power settings can be obtained.

In a switched heating element for a cooker it is desirable that the different power levels should be in approximate geometric progression.

Accordingly in a preferred embodiment the resistance of each tungsten-halogen lamp at its nominal rated power is between 1.5 x and 2.5 x the resistance of each resistor, which enables the required approximately geometric progression to be obtained.

Furthermore it is also desirable that at the lowest setting, corresponding to the power level required for proper simmering, the radiation emitted by the lamps should be visible through the ceramic cooker top and at the highest setting the power of the heater unit is the maximum which can be safely transmitted by the cooker top material. As will be seen below, with a choice of preferred component values for the circuit components of the present invention these further objects can also be attained.

In preferred embodiments, switching between certain circuit configurations is accomplished by making and breaking contact between the opposite poles of respective diodes, the other poles of the diodes being connected together so that when contact is made, they form a reverse parallel combination with substantially no impedance, and, when contact is broken they are independently in series with separate branches of the circuit.

The invention, which is defined in the claims appended hereto, will be further explained by way of example only with reference to the accompanying drawings in which:

FIGS. 2-1 to 2-6 are simplified equivalent circuits of the arrangement of FIG. 1 and FIG. 1*a* at various switch settings, FIGS. 3, 4, 4A, 5 and 6 show modifications of the circuit of FIG. 1;

FIG. 6-1 is a simplified equivalent circuit of one setting of the circuit of FIG. 6.

Figure 1:
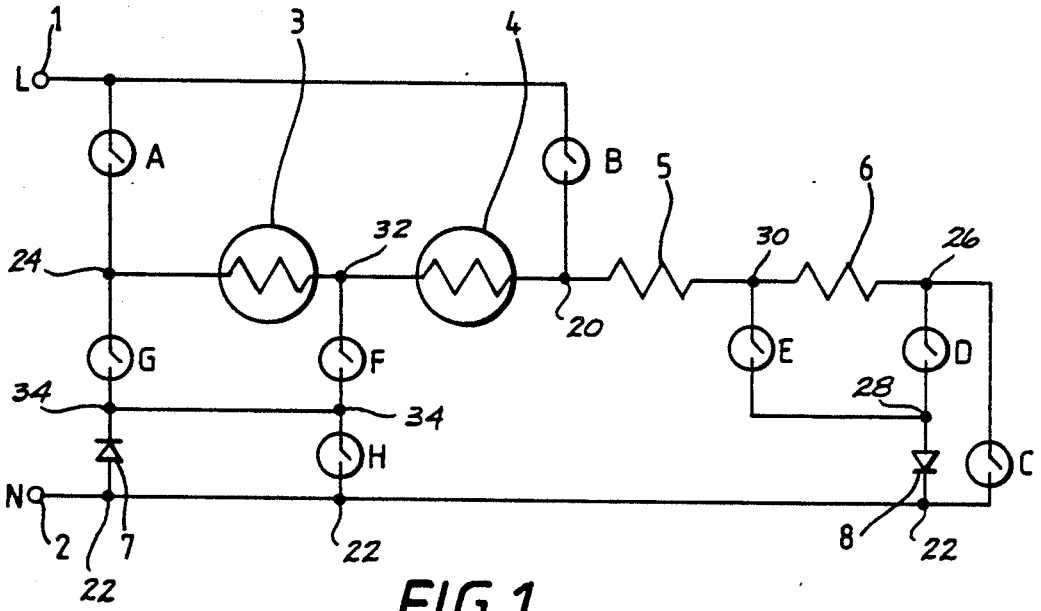
FIG. 1 is a circuit diagram of a controllable electric heater according to the invention suitable for use in a ceramic hob cooker.

The controllable electric heating of this invention is described with reference to FIG. 1. The controllable electric heater has an electric heating element group that includes two series connected heating elements 3 and 4, typically in the form of halogen lamps. A resistor group, comprising a pair of series connected resistors 5 and 6, si connected at one end to the electric heating element group at a heating element common point 20 so that heating element 4 and resistor 5 are connected together. A pair of half-wave rectifiers, represented by diodes 7 and 8, are connected together in reverse polarity to a heater common point 22. An energizing voltage is applied from an external power source (not illustrated) to the electric heater through a pair of supply terminals 1 and 2. Supply terminal 2 is a common terminal connected to the heater common point 22.

A control switch assembly, comprising eight sets of switch contacts, A–H, controls the radiated heat by regulating the voltage applied to the heating elements 3 and 4. Switch contact A connects supply terminal 1 to a heating element free point 24 which is adjacent the free end of heating element 3. Switch contact B connects supply terminal 1 to the heating element common point 20. Switch contact C connects a resistor group free point 26, which is adjacent the free end of resistor 6, to the heater common point 22. Switch contact D connects the resistor group free point 26 to a free point 28 adjacent the free end of half-wave rectifier 8. Switch contact E connects free point 28 of diode 8 to a resistor group tap point 30 between resistors 5 and 6. Switch contact F connects a heating element group tap point 32 between heating elements 3 and 4 to a free point 34 adjacent the free end of half-wave rectifier 7. Switch contact G connects heating element free point 24 to free point 34 of half-wave rectifier 7. Switch contact H connects free point 34 of half-wave rectifier 7 to the heater common point 22. In FIG. 1, conductors are shown separating the actual points of points of connection to the heat common point 22 and the free point 34 of diode 7. Electrically however, heater common point 22 and free point 34 of diode 7 can each be considered a single point and are so identified. As described hereinafter, the control switch assembly selectively makes and breaks the connections established by switches contacts A–H to regulate the voltage applied to the heating element group in order to regulate the production of heat.

The lamps 3, 4 and the ohmic elements 5 and 6 are connected end to end, and by closing the switch contacts A and D the four elements may be connected in series with each other and with the half-wave rectifier 8 across the input terminals 1 and 2. This constitutes the lowest switch setting and is shown in FIG. 2-1. At this setting the filaments of the lamps 3 and 4 glow sufficiently brightly to be visible through the ceramic hob of the cooker.

For the next higher setting (FIG. 2-2) is obtained by closing contact C and opening contact D, which effectively shorts out the half wave rectifier 8 thereby approximately doubling the total power delivered by the heater.

Figures 1, 2:
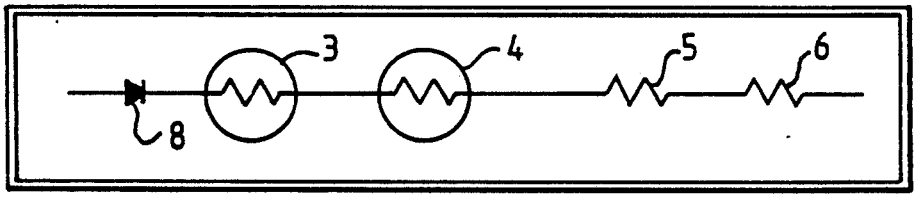
Figure 2:
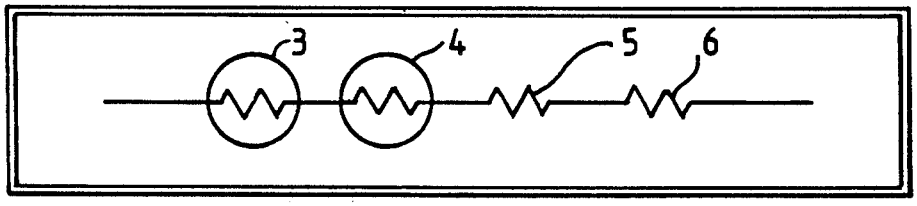

The next higher setting contact A and C are opened, and contacts B,D and G are closed, and this establishes connections providing two circuit branches, one through the lamps 3 and 4 and the rectifier 7, and the other through the resistors 5 and 6 and the rectifier 8. This, again, approximately doubles the power output. The equivalent circuit for this setting is shown in FIG. 2-3.

At the next higher setting switch contacts C and H are also closed, short-circuiting the two half-wave rectifiers 7 and 8 and thereby applying full-wave power to the two circuit branches further increasing the power output from the heater. The equivalent circuit at this stage is shown in FIG. 2 - 4.

At the fifth switch setting, contacts C,D,G and H are opened, and A,B,E and F are closed, and this establishes a circuit having two main branches, one of which comprises the lamps 3 and 4 in parallel with each other and in series with the half-wave rectifier 7, and the other comprises the resistor 5 in series with the half-wave rectifier 8. The equivalent circuit is shown in FIG. 2 - 5.

Finally, to obtain the highest power setting, switch contacts C,D and H are additionally closed, effectively short-circuiting the two rectifiers 7 and 8 and again doubling the heat output from the heater.

The following table shows the contact settings in the above six positions of the switch. In the table zeros represent open contacts, and ones represent closed contacts. The contacts are all associated with a single rotary gauged switch, which enables the heat output to be raised sequentially by rotating a suitable control knob.

TABLE 1

| | A | B | C | D | E | F | G | H |
|---|---|---|---|---|---|---|---|---|
| 1 | 1 | 0 | 0 | 1 | 0 | 0 | 0 | 0 |
| 2 | 1 | 0 | 1 | 0 | 0 | 0 | 0 | 0 |
| 3 | 0 | 1 | 0 | 1 | 0 | 0 | 1 | 0 |
| 4 | 0 | 1 | 1 | 1 | 0 | 0 | 1 | 1 |
| 5 | 1 | 1 | 0 | 0 | 1 | 1 | 0 | 0 |

TABLE 1-continued

| | A | B | C | D | E | F | G | H |
|---|---|---|---|---|---|---|---|---|
| 6 | 1 | 1 | 1 | 1 | 1 | 1 | 0 | 1 |

Figure 1A:
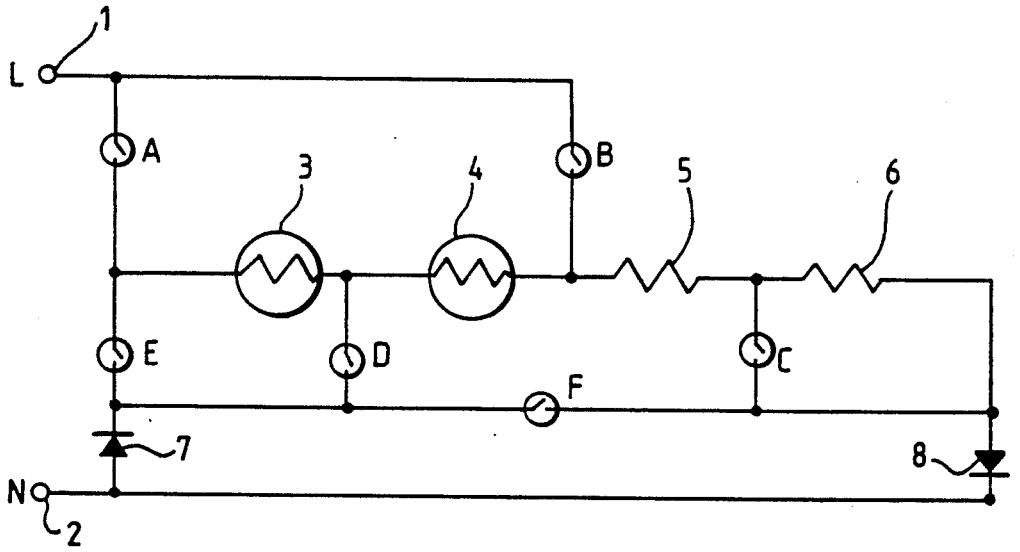
FIG. 1A is a variant of the circuit of FIG. 1.

FIG. 1A differs from FIG. 1 in that switch contacts F are connected between the free ends of diodes 7 and 8, allowing contacts G & H to be dispensed with. Accordingly the switch may be a low costs standard 6-pole switch, rather than the 8-pole switch required in the circuit of FIG. 1.

Table 1A shows the switching sequences for this circuit.

TABLE 1A

| | A | B | C | D | E | F |
|---|---|---|---|---|---|---|
| Setting 0 | 0 | 0 | x | x | x | x |
| Setting 1 | 1 | 0 | 0 | 0 | 0 | 0 |
| Setting 2 | 1 | 0 | 0 | 0 | 0 | 1 |
| Setting 3 | 0 | 1 | 0 | 0 | 1 | 0 |
| Setting 4 | 0 | 1 | 0 | 0 | 1 | 1 |
| Setting 5 | 1 | 1 | 1 | 1 | 0 | 0 |
| Setting 6 | 1 | 1 | 1 | 1 | 0 | 1 |

0 = Open Circuit
1 = Closed Circuit
x = Don't Care

Figures 2, 2A:
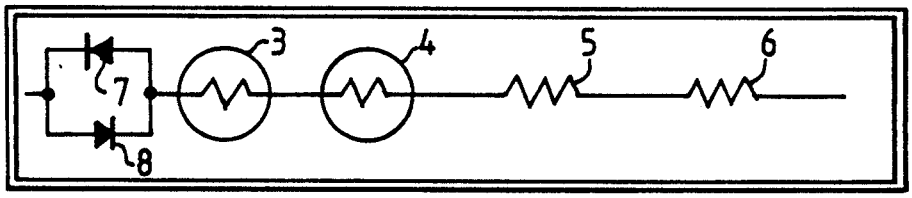
Figures 2, 3:
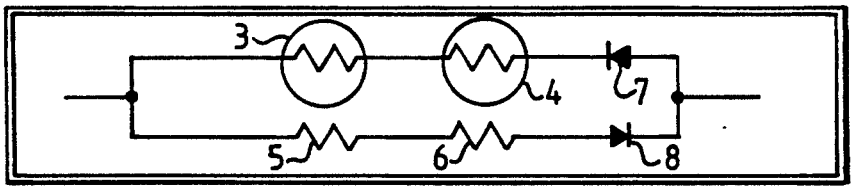
Figures 2, 3, 4:
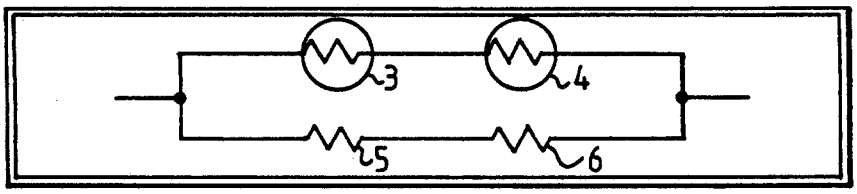

FIG. 2-2A shows the simplified equivalent circuit for setting 2 in Table 1A and FIGS. 2-4A and 2-6A relate to the 4th and 6th settings respectively in this Table. The other settings correspond to FIGS. 2-1, 2-3 and 2-5.

As mentioned previously it is desirable that at the minimum power setting the light from the lamps should be visible through the ceramic cooker hob. We have found that the following relation exists between the minimum visible voltage, the nominal lamp voltage, the minimum power setting, and the supply voltage.

$$\text{NOMINAL LAMP POWER} = W_L \times V_N^{1.585}/(V_M \times V_L^{0.585})$$

where;

$W_L$ = Power dissipated in setting 1.
$V_N$ = Nominal Lamp Voltage.
$V_M$ = Applied voltage across the network.
$V_L$ = Minimum Visible Voltage.

By using the above formula it is possible to determine appropriate values for the ohmic resistors.

In one particular heater constructed according to the present invention the lamps were 450 watt tungsten halogen lamps their minimum visible voltage through a Corning 9632 or similar ceramised quartz glass cook top was approximately 40 volts, and the ohmic ballast resistors were each of 62 ohms. With these components both the total power levels of the six settings and the lamp power levels approximated to a geometric series.

The choice of the value of 62 ohms for both $R_1$ and $R_2$ is merely convenient. Obviously a higher power for the sixth setting could be obtained by making $R_1$ lower, and provided $R_1+R_2=124$ ohms, settings 1 to unchanged. Hence the maximum power level attainable at the higher setting is not constrained by circuit parameters.

Figures 2, 3, 4, 4A:
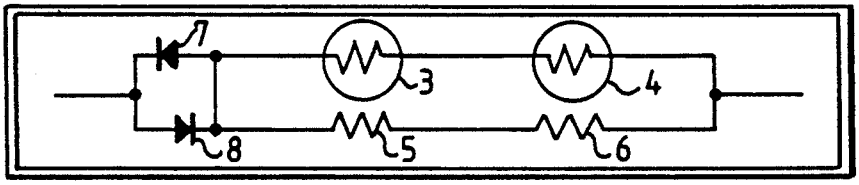

The arrangements of the switch contacts to give the required connections shown in FIGS. 1 and 1A are not unique and FIGS. 3 4 and 4A show further possible contact arrangements. The operation of these embodiments is generally similar and will be self evident from the foregoing description. In particular, FIG. 4A is a variant similar to FIG. 1A in which the free ends of diodes 7 and 8 are connected to switch contacts F, enabling contacts E of FIG. 4 to be dispensed with.

The switching sequence for FIG. 4A is shown in Table 2.

TABLE 2

| | A | B | C | D | F |
|---|---|---|---|---|---|
| Setting 0 | 3 | 0 | X | X | X |
| Setting 1 | 2 | 0 | 0 | 0 | 0 |
| Setting 2 | 2 | 0 | 0 | 0 | 1 |
| Setting 3 | 3 | 1 | 0 | 0 | 0 |
| Setting 4 | 3 | 1 | 0 | 0 | 1 |
| Setting 5 | 2 | 1 | 1 | 1 | 0 |
| Setting 6 | 2 | 1 | 1 | 1 | 1 |

0 = Open Circuit
1 = Closed Circuit
x = Don't Care
2 = At pole 2
3 = At pole 3

Figures 2, 3, 4, 5:
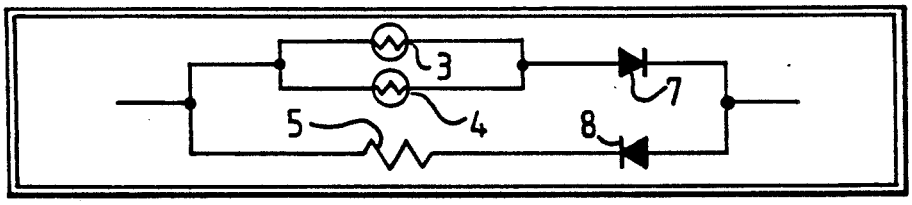

FIG. 5 is a slightly modified form of circuit which requires only seven switch poles instead of the eight needed by the circuit of FIG. 1. The switch settings for the different power levels are shown in Table III.

TABLE III

| | Pole Numbers | | | | | | |
|---|---|---|---|---|---|---|---|
| Settings | A | B | C | D | E | F | G |
| 1 | 1 | 0 | 0 | 0 | 0 | 0 | 0 |
| 2 | 1 | 0 | 1 | 0 | 0 | 0 | 0 |
| 3 | 0 | 1 | 0 | 0 | 0 | 1 | 0 |
| 4 | 0 | 1 | 1 | 0 | 0 | 1 | 1 |
| 5 | 1 | 1 | 0 | 1 | 1 | 0 | 0 |
| 6 | 1 | 1 | 1 | 1 | 1 | 0 | 1 |

Figures 2, 3, 4, 5, 6:
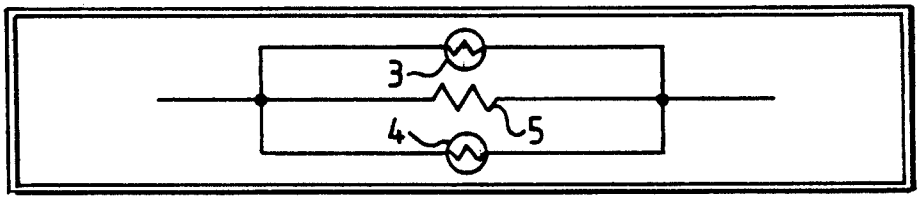
Figures 2, 3, 4, 5, 6, 6A:
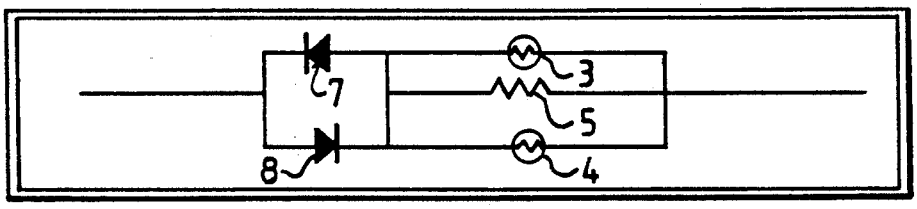
Figure 3:
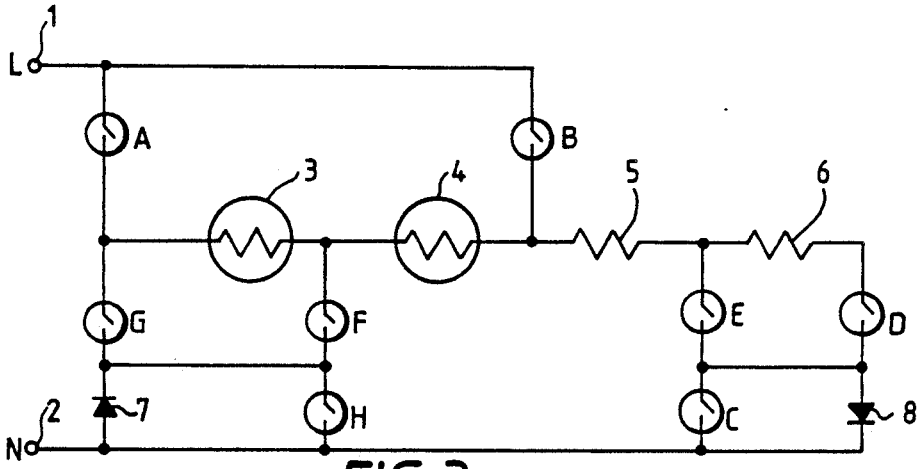
Figure 4:
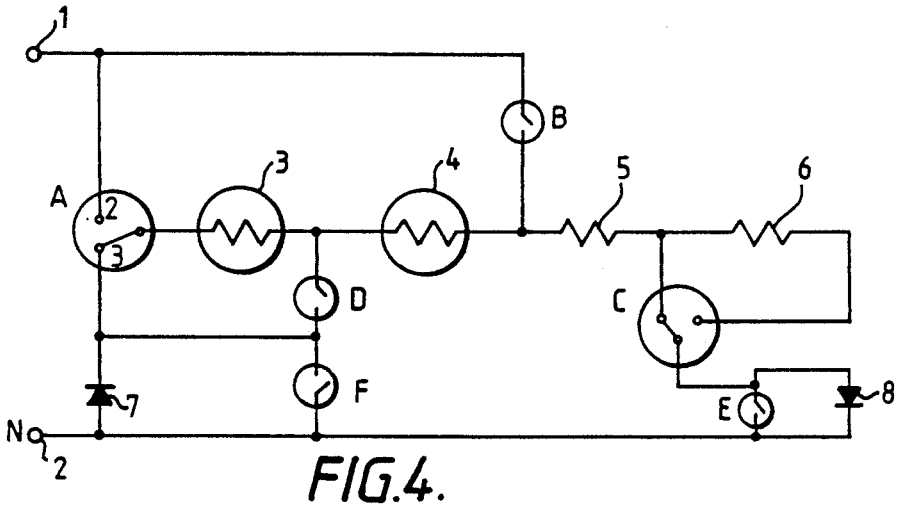
Figure 4A:
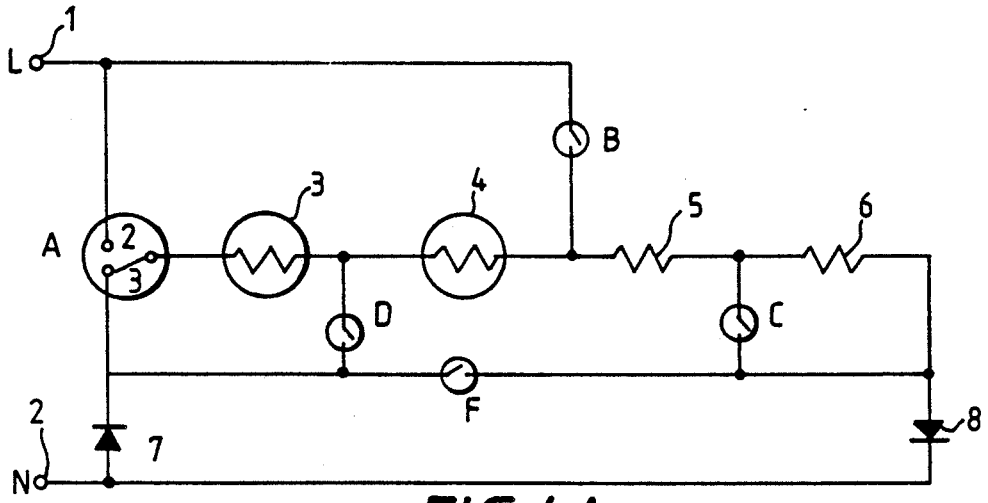
Figures 1, 6:
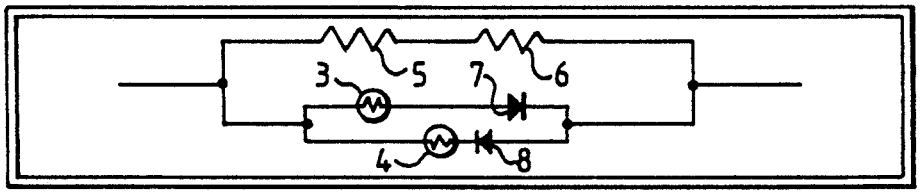
Figure 5:
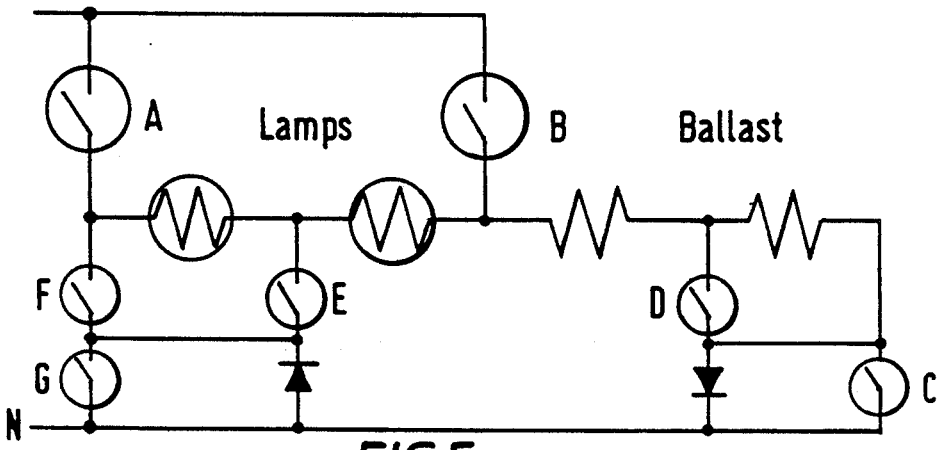
Figure 6:
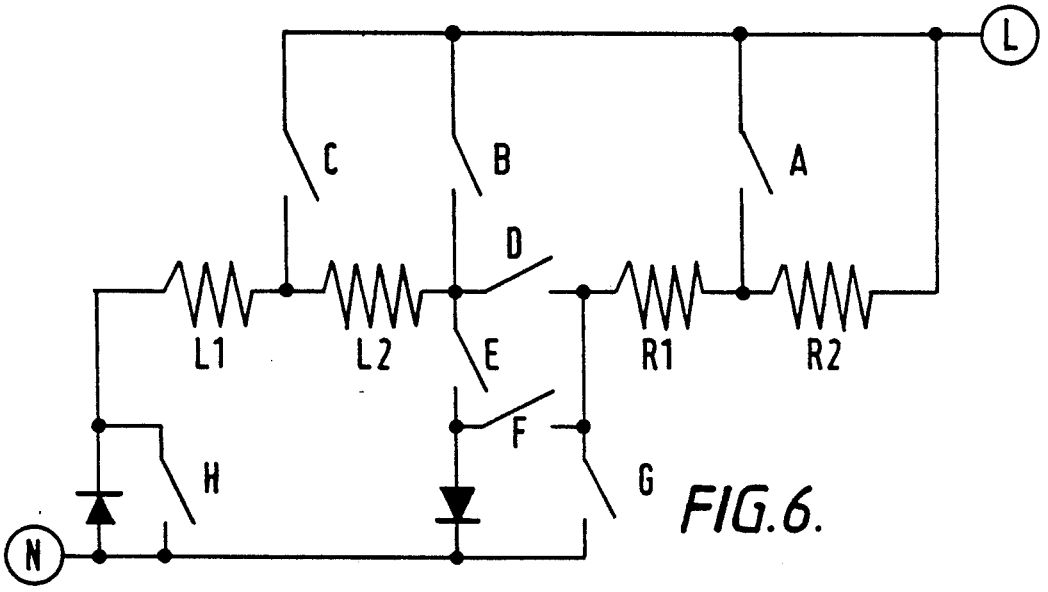

FIG. 6 shows a further circuit according to the invention, and TAble IV shows the relevant switch settings. In this table open contacts are denoted by "0" closed by "1", as before and "X" indicates that it is immaterial whether the contacts are open or closed.

TABLE IV

| Setting | A | B | C | D | E | F | G | H |
|---|---|---|---|---|---|---|---|---|
| 0 | 0 | 0 | 0 | 0 | 0 | 0 | 0 | 0 |
| 1 | 0 | 0 | 0 | 0 | 1 | 0 | 0 | 0 |
| 2 | 0 | 0 | 0 | 1 | 0 | 0 | 0 | 1 |
| 3 | 0 | 1 | 0 | 0 | 0 | 1 | 0 | 0 |
| 4 | 0 | 1 | 0 | 0 | 0 | X | 1 | 1 |
| 5 | 0 | 0 | 1 | 0 | 1 | 0 | 1 | 0 |
| 6 | 1 | 0 | 1 | 1 | 0 | 0 | 1 | 1 |

The equivalent circuits for settings 1,2,3,4, and 6 are identical with those of FIGS. 2 - 1 to 2 - 4 and 2 - 6. The equivalent circuit for the fifth power level, however, is slightly different, and is shown in FIG. 6-1. The circuit of FIG. 6 has the advantage of reducing the load on the diodes, thereby allowing the use of lower-rated diodes, or raising the limit on the ambient temperature at which the circuit can operate.

Figure 7:
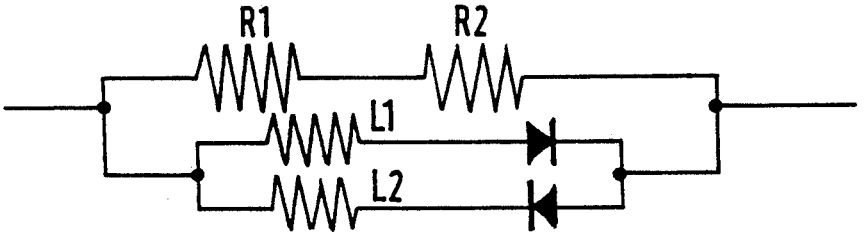
FIG. 7 is another simplified version of FIG. 6

FIG. 7 (setting 5 in Table IV) is an equivalent and simplified circuit of FIG. 6 in which resistors R1 and R2 are shown in series with each other and are together in parallel with L1 and L2 which are themselves in parallel and in series with associated half-wave rectifiers 7 and 8 respectively.

What is claimed is:

1. A controllable AC electric heating assembly comprising:

(a) an electric heating element group having a free connection point and a common connection point;

(b) a resistor group connected at one end to said electric heating element group common connection point and having at an opposite end a free connection point;

(c) first and second half-wave rectifiers connected in reverse polarity at an assembly common point, and each said rectifier having a free connection point;

(d) a pair of terminals for connection to an external AC power source, one said terminal being connected to said assembly common point and the other said terminal being a free terminal; and (e) a switch means connected to said electric heating element group free connection point, said resistor group free connection point, said rectifier free connection points, and said free terminal and having:

(i) a first configuration in which said electric heating element and said resistor group are connected in series with one of said half-wave rectifiers so that said electric heating element group and said resistor group are energized by half-wave rectified AC voltage;

(ii) a second configuration in which said resistor group is connected in series with one of said half-wave rectifiers and said electric heating element group is connected in series with the other of said half-wave rectifiers, so that said resistor group and said electric heating element group are individually energized by a half-wave rectified AC voltage; and (iii) a third configuration in which said half-wave rectifiers are each bypassed, and said electric heating element group and said resistor group are connected in series so that said electric heating element group and said resistor group are energized by a full wave AC voltage.

2. The electric heating assembly of claim 1, wherein said witching means is further connected to said electric heating element group common connection point and has:

(iv) a fourth configuration in which said half-wave rectifiers are each bypassed, and said electric heating element group and said resistor group are connected together in parallel so that an undivided full wave AC voltage is supplied to said electric heating element group.

3. The electric heating assembly of claim 2, wherein said electric heating element group includes two series-connected heating elements having a tap point located therebetween, and said resistor group includes two series-connected resistors having a tap point located therebetween and said switch means is connected to said electric heating element tap point and said resistor group tap point and further includes:

(v) a fifth configuration in which said heating elements are connecting in parallel and said heating elements are connected in series with one of said half-wave rectifiers to form a first circuit branch and in which the other of said half-wave rectifiers is connected in series with one of said resistors to form a second circuit branch which is connected in parallel with said first circuit branch whereby said one resistor and said parallel combination of heating elements are each energized by an undivided half-wave rectified AC voltage; and (vi) a sixth configuration in said half-wave rectifiers are bypassed and one of said resistors and said electric heating elements are connected in parallel and are energized by undivided full wave AC voltage.

4. The electric heating assembly of claim 1, wherein said electric heating element group consists of at least one tungsten-halogen lamp.

5. The controllable electric heating assembly of claim 3, wherein each of said heating elements is a tungsten-halogen lamp and the resistance of each said lamp is between 1.5 and 2.5 times the resistance of each said resistor, whereby the respective heat output values obtained from said six configuration of said switching means are in a geometric progression.

* * * * *

UNITED STATES PATENT AND TRADEMARK OFFICE

CERTIFICATE OF CORRECTION

PATENT NO. : 4,990,752

DATED : February 5, 1991

INVENTOR(S) : Worrall et al.

It is certified that error appears in the above-identified patent and that said Letters Patent is hereby corrected as shown below:

| Column | Line | |
|---|---|---|
| 2 | 41 | Delete "si" and insert --is-- therefor |
| 3 | 5 | Delete "points of" (second occurence) |
| 3 | 10 | Delete "switches" and insert --switch-- therefor |
| 4 | 9 | Delete "costs" and insert --cost-- therefor |
| 4 | 58 | After "to" insert --4 will remain-- |
| 4 | 64 | Delete "FIGS. 3 4" and insert --FIGS. 3, 4-- therefor |
| 5 | 34 | Delete "TAble IV" and insert --Table IV-- therefor |
| 6 | 35 | Delete "witching" and insert --switching-- therefor |
| 8 | 3 | Delete "configuration" and insert --configurations-- therefor |

Signed and Sealed this

Twenty-eighth Day of July, 1992

*Attest:*

DOUGLAS B. COMER

*Attesting Officer*

*Acting Commissioner of Patents and Trademarks*